US006425793B1

(12) United States Patent
Hasegawa et al.

(10) Patent No.: US 6,425,793 B1
(45) Date of Patent: Jul. 30, 2002

(54) IMPREGNATED CATHODE AND METHOD OF MANUFACTURING SAME, ELECTRON GUN AND ELECTRON TUBE

(75) Inventors: Yoji Hasegawa; Shinji Ogawa, both of Kanagawa; Daichi Imabayashi; Makoto Furukawa, both of Fukushima; Nobuyuki Yoshino, Saitama; Junji Sato, Saitama; Yoshirou Hirai, Saitama; Naoto Ogasawara, Saitama; Kuniyasu Kobayashi, Nagano, all of (JP)

(73) Assignees: Sony Corporation; Citizen Watch Co., Ltd.; Cimeo Precision Co., Ltd., all of (JP)

( * ) Notice: Subject to any disclaimer, the term of this patent is extended or adjusted under 35 U.S.C. 154(b) by 0 days.

(21) Appl. No.: 09/671,689

(22) Filed: Sep. 28, 2000

Related U.S. Application Data

(62) Division of application No. 09/184,132, filed on Nov. 2, 1998.

(30) Foreign Application Priority Data

Nov. 4, 1997 (JP) ..... 9-302176
Oct. 21, 1998 (JP) ..... 10-300114

(51) Int. Cl.[7] ..... H01J 19/06
(52) U.S. Cl. ..... 445/51; 313/346 R
(58) Field of Search ..... 445/51; 313/346 R, 313/346 DC

(56) References Cited

U.S. PATENT DOCUMENTS 4,823,044 A * 4/1989 Falce ..... 313/346 R
5,171,180 A * 12/1992 Lee ..... 445/51
6,034,469 A * 3/2000 Uda et al. ..... 313/346 R

FOREIGN PATENT DOCUMENTS

JP 53-14548 * 2/1978 ..... 313/346 R
JP SHO60-62034 4/1985

* cited by examiner

*Primary Examiner*—Kenneth J. Ramsey
*Assistant Examiner*—Thelma Sheree Clove
(74) *Attorney, Agent, or Firm*—Rader, Fishman & Grauer PLLC; Ronald P. Kananen, Esq.

(57) ABSTRACT

An impregnated cathode and a method of manufacturing the same are provided for suppressing emission of unwanted electrons and particles generated from an excess electron emitting substance so as to achieve a steady electron emission characteristic. The impregnated cathode is placed directly beneath an electron emission hole of a first grid. The impregnated cathode is made up of a first sintered porous element whose surface functions as an electron emitting region and a second sintered porous element whose surface is a peripheral region other than the electron emitting region. The porosity of the first sintered porous element is greater than that of the second sintered porous element. Not only the first sintered porous element having the electron emitting region but also the second sintered porous element corresponding to the region around the electron emitting region is impregnated with the electron emitting substance. In addition, the amount of the electron emitting substance per unit volume contained in the first sintered porous element is greater than that contained in the second sintered porous element.

12 Claims, 12 Drawing Sheets

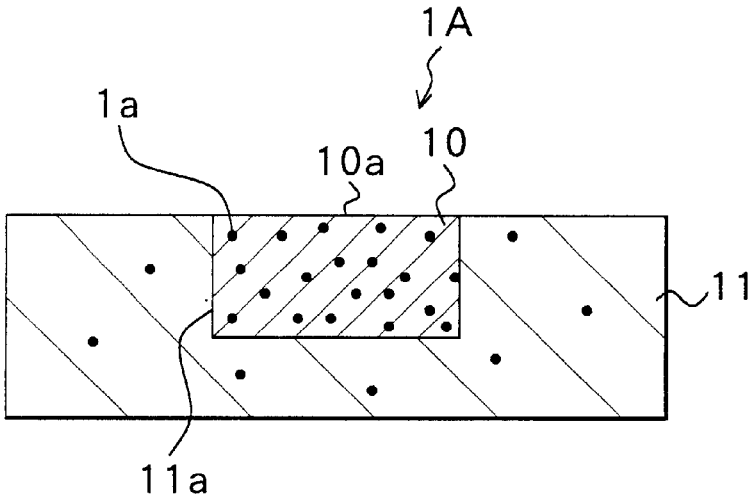
FIG.1
FIG.2A
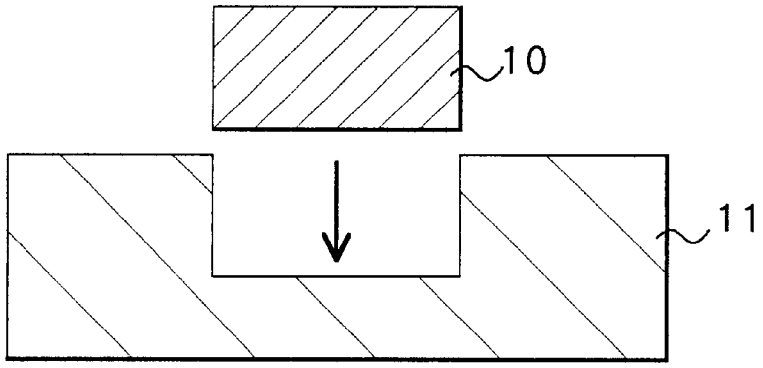
FIG.2B
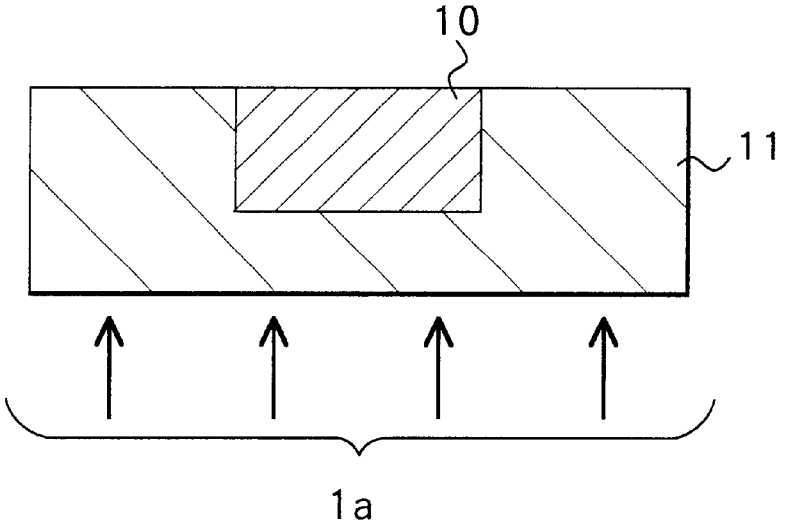

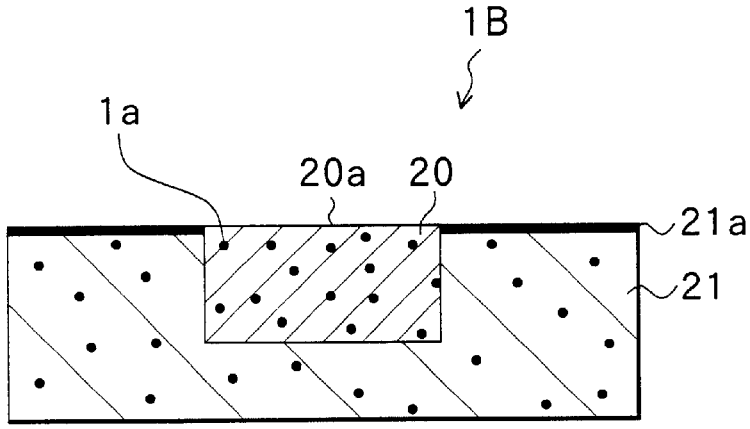
FIG.6
FIG.7A
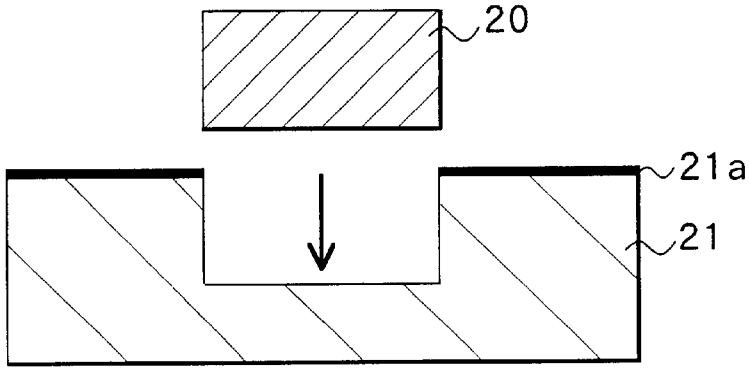
FIG.7B
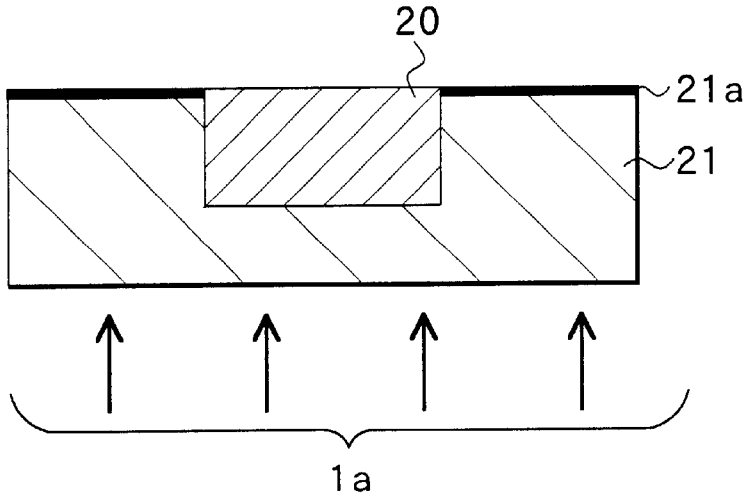

IMPREGNATED CATHODE AND METHOD OF MANUFACTURING SAME, ELECTRON GUN AND ELECTRON TUBE

This application is a division of Ser. No. 09/184,132 filed Nov. 2, 1998.

BACKGROUND OF THE INVENTION

1. Field of the Invention

The present invention relates to an impregnated cathode made of a porous element of a refractory metal and so on impregnated with an electron emitting substance (emitter) such as barium oxide (BaO) and a method of manufacturing the same, an electron gun and an electron tube.

2. Description of the Related Art

An impregnated cathode is used for an electron gun of a cathode-ray tube such as a picture tube and a display tube or an electron gun of an electron tube such as an image pickup tube and a high-frequency oscillator tube. Electrons (thermoelectrons) are emitted from the impregnated cathode.

The factors that determine the performance of such an impregnated cathode include a cathode cutoff voltage characteristic and a grid emission characteristic. It is important to reduce variations in the cathode cutoff voltage. The cathode cutoff voltage depends on the distance between the cathode and the first grid, the distance between the first and second grids, the thickness of the first and second grids, the aperture diameter of the first and second grids and so on. The grid emission is a symptom in which unintended emission of electrons occurs from excess barium and the like deposited on the grids (G1, G2 and so on). The grid emission is thus required to be reduced. In order to suppress unintended emission of electrons while maintaining the cathode cutoff voltage characteristic, it is required to increase the porosity in the electron emission region (working area) of the surface of the sintered porous element making up the impregnated cathode. At the same time, it is required to reduce the porosity rate or eliminate the pores in the other region so as to prevent the electron emitting substance for impregnation from being excessively vaporized through the region other than the electron emitting region.

Related-art impregnated cathodes are largely categorized into those of a single structure and those of a dual structure. The single-structure cathode only consists of a sintered porous element made of a refractory metal such as tungsten (W). The dual-structure cathode (such as the one disclosed in Japanese Patent Application Laid-open Sho 60-62034 [1985]) includes the electron emission region made of a porous sintered body and the region surrounding the electron emitting region made of a nonporous refractory metal. The two regions are fixed to each other through welding, for example.

However, such related-art impregnated cathodes have the following problems. It is difficult to make desired local variations of the porosity of the single-structure cathode made of a sintered porous element only. It is therefore extremely difficult to obtain the impregnated cathode whose impregnation amount of electron emitting substance is controlled as desired. If the cathode is impregnated with an ample amount of electron emitting substance so as to achieve a stable electron emission characteristic, barium (Ba) or barium oxide (BaO) as an electron emitting substance may evaporate and deposit onto the first or second grid during an operation of the cathode. As a result, the distance between the cathode and the first grid, and the distance between the first and second grids change and the cathode cutoff voltage drifts. Furthermore, it is impossible to reduce the grid emission.

On the other hand, in the dual-structure cathode made of a sintered porous element and a nonporous refractory metal, the refractory metal does not function as a storage of the electron emitting substance since the refractory metal is not capable of being impregnated with the electron emitting substance. Consequently, it is impossible to keep a sufficient amount of electron emission substance in the cathode for achieving a stable electron emission characteristic. The electron emission characteristic is thereby reduced and the life of the cathode is shortened. Another problem is that the manufacturing process is complicated and costs rise.

SUMMARY OF THE INVENTION

It is an object of the invention to provide an impregnated cathode and a method of manufacturing the same that suppress emission of unwanted electrons and particles generated from an excess electron emitting substance so as to achieve a steady electron emission characteristic and a long life of the cathode.

It is another object of the invention to provide an electron gun and an electron tube, each comprising such an impregnated cathode and having a steady characteristic.

An impregnated cathode of the invention is made of a conductive porous element having an electron emitting region and a peripheral region other than the electron emitting region and impregnated with an electron emitting substance in a surface thereof. The porous element has such a configuration that a porosity of part corresponding to the electron emitting region and a porosity of part corresponding to the peripheral region are different from each other. To be specific, the porosity of the part corresponding to the electron emitting region is greater than the porosity of the part corresponding to the peripheral region.

Another impregnated cathode of the invention has such a configuration that the porous element includes a nonporous surface in the peripheral region other than the electron emitting region.

Still another impregnated cathode of the invention has such a configuration that the porous element is made of a plurality of porous elements whose porosities are different from one another combined with one another, sintered and fixed to one another.

A method of manufacturing an impregnated cathode of the invention includes the steps of: separately fabricating a plurality of conductive porous elements whose porosities are different from one another; fixing the porous elements to one another and integrating the porous elements with one another; and having the porous elements each impregnated with an electron emitting substance.

Another method of manufacturing an impregnated cathode of the invention includes the steps of: separately fabricating a first conductive porous element and a second conductive porous element whose porosity is lower than that of the first porous element, the second porous element having a concave capable of accommodating the first porous element; having the concave of the second porous element filled with an electron emitting substance; and fixing the first porous element into the concave of the second porous element filled with the electron emitting substance and having the electron emitting substance diffused into the first and second porous elements.

Still another method of manufacturing an impregnated cathode of the invention includes the steps of: fabricating a conductive porous element including part corresponding to an electron emitting region and part corresponding to a peripheral region other than the electron emitting region in a surface of the porous element; grinding the part corresponding to the peripheral region of the porous element to form a nonporous surface; and having the porous element impregnated with an electron emitting substance.

Still another method of manufacturing an impregnated cathode of the invention includes the steps of: separately fabricating a first conductive porous element and a second conductive porous element whose porosity is lower than that of the first porous element, the second porous element having a concave capable of accommodating the first porous element; grinding a surface of the second porous element to form a nonporous surface; and fixing the first porous element into the concave of the second porous element and having the first and second porous elements each impregnated with an electron emitting substance.

Still another method of manufacturing an impregnated cathode includes the steps of: molding a plurality of conductive substances and fabricating a plurality of porous elements; provisionally sintering each of porous elements so that the shrinkage factors thereof are different from one another; sintering the porous elements combined with one another and fixing the porous elements to one another; and having the porous elements each impregnated with an electron emitting substance.

An electron gun of the invention includes a grid with an electron emission hole and an impregnated cathode made of a conductive porous element having an electron emitting region at least larger than the electron emission hole and a peripheral region other than the electron emitting region and impregnated with an electron emitting substance. The porous element of the impregnated cathode has such a configuration that a porosity of part corresponding to the electron emitting region and a porosity of part corresponding to the peripheral region are different from each other.

Another electron gun of the invention further includes a nonporous surface in the peripheral region in the surface of the porous element.

An electron tube of the invention comprises an electron gun including a grid with an electron emission hole and an impregnated cathode made of a conductive porous element having an electron emitting region at least larger than the electron emission hole and a peripheral region other than the electron emitting region and impregnated with an electron emitting substance. The porous element of the impregnated cathode has such a configuration that a porosity of part corresponding to the electron emitting region and a porosity of part corresponding to the peripheral region are different from each other.

Another electron tube of the invention further includes a nonporous surface in the peripheral region in the surface of the porous element.

In the impregnated cathode, the electron gun and the electron tube of the invention, the porosity of part corresponding to the electron emitting region of the porous element and the porosity of part corresponding to the peripheral region are different from each other. To be specific, the porosity of the part corresponding to the electron emitting region is greater than the porosity of the part corresponding to the peripheral region. As a result, the amount of the electron emitting substance contained in the part corresponding to the electron emitting region is different from the amount contained in the part corresponding to the peripheral region. Emission of electrons from the electron emitting region is therefore steadily performed. With the nonporous surface provided in the peripheral region other than the electron emitting region, evaporation of unwanted electron emitting substances and so on is suppressed and deposition thereof onto the grid is suppressed.

According to the other impregnated cathode, electron gun and electron tube of the invention, the nonporous surface provided in the peripheral region of the porous element suppresses emission of electron emitting substances from the peripheral region.

According to still the other impregnated cathode of the invention, the shrinkage factors of the plurality of porous elements are different from one another. As a result, no clearance is formed in the interface between the sintered porous elements during manufacturing. Emission of electrons from the electron emitting region is thereby steadily performed.

According to the method of manufacturing an impregnated cathode of the invention, the plurality of porous elements whose porosities are different from one another are fabricated in advance and the porous elements are then impregnated with the electron emitting substance. The impregnated cathode wherein the distribution of the electron emitting substance varies is thereby obtained.

According to the other method of manufacturing an impregnated cathode of the invention, the electron emitting substance fed into the concave of the second porous element is diffused into the first and second porous elements and the porous elements are impregnated with the electron emitting substance.

According to still the other method of manufacturing an impregnated cathode of the invention, the peripheral region of the porous element is ground to form the nonporous surface for suppressing emission of electron emitting substances and so on.

According to still the other method of manufacturing an impregnated cathode of the invention, the impregnated cathode is manufactured wherein the distribution of the electron emitting substance contained in the electron emitting region is different from that in the peripheral region and the nonporous surface is provided in the peripheral region.

According to still the other method of manufacturing an impregnated cathode of the invention, the plurality of porous elements whose shrinkage factors are different from one another are fabricated in advance and the porous elements are then fixed to one another by sintering.

Other and further objects, features and advantages of the invention will appear more fully from the following description.

BRIEF DESCRIPTION OF THE DRAWINGS

FIG. 1 is a cross section of an impregnated cathode of a first embodiment of the invention.

FIG. 2A and FIG. 2B are cross sections for illustrating a method of manufacturing the impregnated cathode of the first embodiment of the invention.

FIG. 6 is a cross section of an impregnated cathode of a second embodiment of the invention.

FIG. 7A and FIG. 7B are cross sections for illustrating a method of manufacturing the impregnated cathode of the second embodiment of the invention.

DETAILED DESCRIPTION OF THE PREFERRED EMBODIMENTS

Preferred embodiments of the invention will now be described in detail with reference to the accompanying drawings.

First Embodiment

Figure 4:
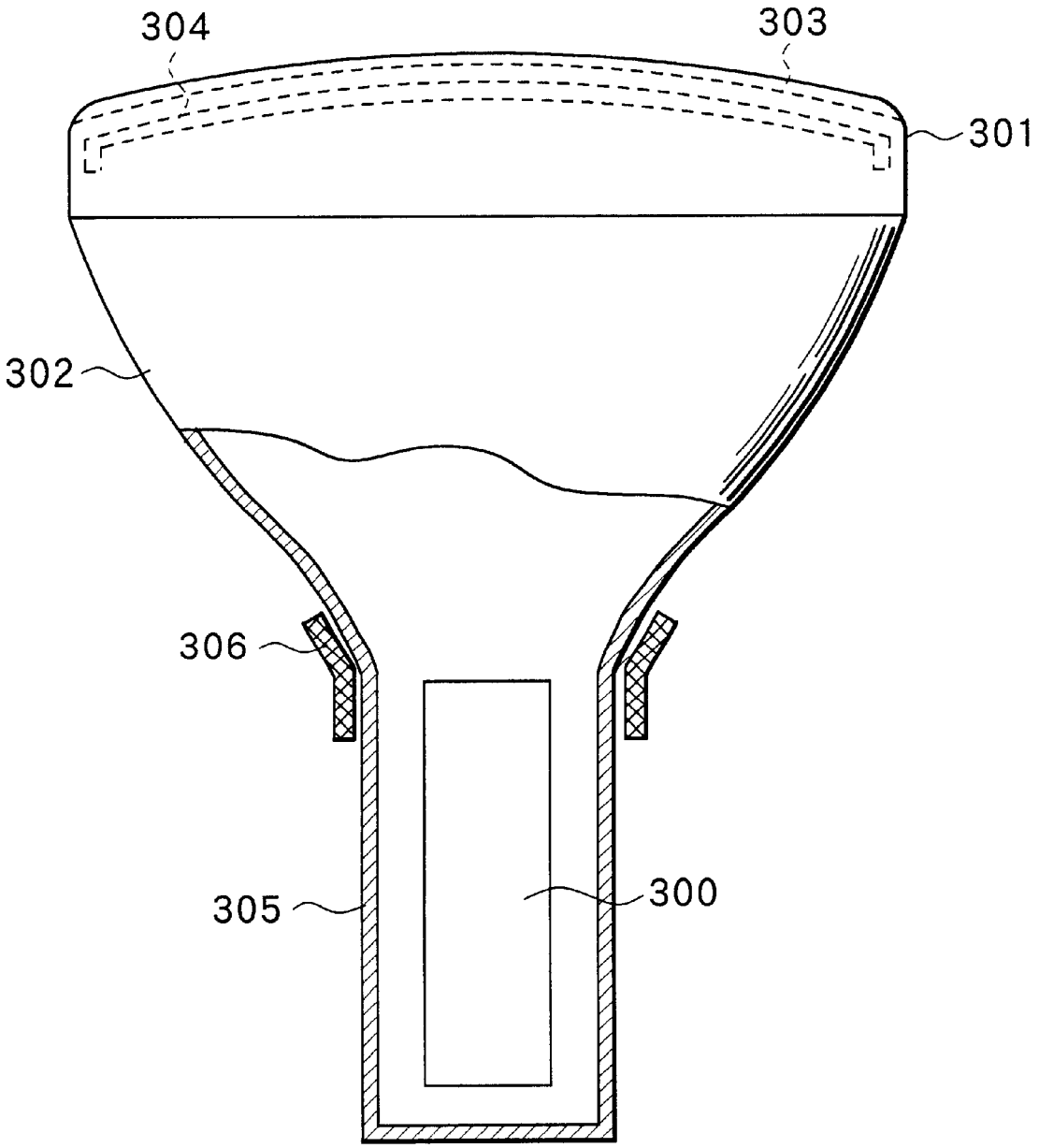
FIG. 4 is a cross section of a cathode-ray tube using the impregnated cathode shown in FIG. 1.

FIG. 4 shows a cross section of part of an example of a cathode-ray tube including an impregnated cathode of a first embodiment of the invention. The cathode-ray tube incorporates an electron gun 300 including the impregnated cathode and comprises a panel 301 made of glass and a funnel 302 made of glass. The panel 301 and the funnel 302 are sealed with each other with a sealant such as frit glass so as to maintain the inside of the panel 301 and the funnel 302 at a high vacuum. A phosphor screen 303 is provided inside the panel 301. A color selector (an aperture grill) 304 is installed behind the phosphor screen 303. The base of the funnel 302 is a long and narrow neck 305 in which the electron gun 300 mentioned above is placed. Three electron beams of red, blue and green, for example, emitted from the electron gun 300 are each deflected by a deflection yoke 306 and applied to phosphors of the respective colors of the phosphor screen 303 through the color selector 304.

Figure 5:
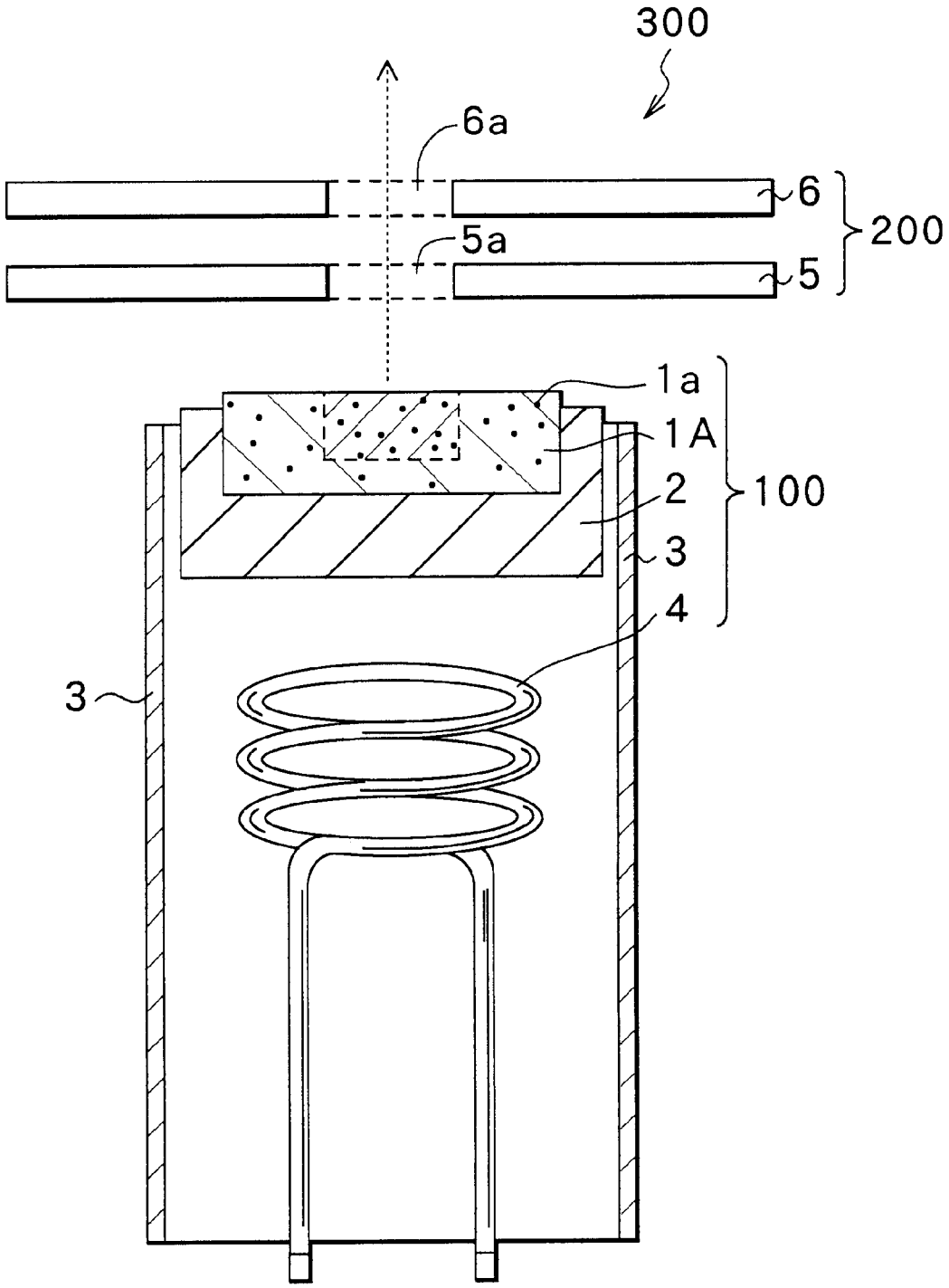
FIG. 5 is a cross section of an electron gun using the impregnated cathode shown in FIG. 1.

FIG. 5 is a schematic view of the electron gun 300. The electron gun 300 has a cathode unit 100 and a grid group 200 including a first grid 5 and a second grid 6. The cathode unit 100 has an impregnated cathode 1A that will be described in detail below; a cap 2 made of a refractory metal such as molybdenum (Mo) or tantalum (Ta); a sleeve 3 made of tantalum, for example, and having a thickness of 20 $\mu$m; and a heater 4 made of a heating wire of pure tungsten (W) or an alloy of tungsten with 2 to 3 percent of rhenium (Re). The impregnated cathode 1A is fitted to the cap 2 and fastened to the sleeve 3 by means of the cap 2. The heater 4 is placed inside the sleeve 3. An electron emitting substance 1*a* is heated to 1000° C., for example, by the heater 4 and thereby activated and emits electrons through electron emission holes (beam holes) 5*a* and 6*a*. The sleeve 3 is incorporated in the cathode-ray tube through any of various supporting methods (not shown).

In the electron gun 300, the temperature of the cathode unit 100 is heated up to about 1000° C. by the heater 4 and electrons (thermoelectrons) are emitted from the electron emitting substance 1*a*. Of the emitted electrons, those passing through the electron emission hole 5*a* of the first grid 5 and the electron emission hole 6*a* of the second grid 6 are effective electrons. The effective electrons are outputted as electron beams and applied to the phosphor screen 303 shown in FIG. 4 as described above.

Referring to FIG. 1 and FIG. 2, the specific configuration of the impregnated cathode 1A and a method of manufacturing the cathode will now be described. The impregnated cathode 1A is made up of two kinds of conductive porous elements whose porosities are different from each other. The porous elements may be both formed through pressing a refractory metal, for example, such as tungsten whose grain diameter is about 5 $\mu$m and then heating and sintering the metal. The porous elements will be called sintered porous elements in the following description.

The impregnated cathode 1A is placed directly beneath the electron emission hole 5*a* of the first grid 5 and the electron emission hole 6*a* of the second grid 6. The impregnated cathode 1A is made up of a sintered porous element 10 as a first porous element whose surface functions as an electron emitting region 10*a* and a sintered porous element 11 as a second porous element whose surface is a peripheral region other than the electron emitting region. The sintered porous element 10 takes a cylindrical shape whose diameter is slightly greater than that of each of the electron emission holes 5*a* and 6*a* of the first grid 5 and the second grid 6, respectively. The sintered porous element 11 has a concave 11*a* in which the sintered porous element 10 is placed. The sintered porous element 10 being fitted and fixed to the concave 11*a*, the surfaces of the sintered porous elements 10 and 11 are both in one plane.

The porosity of the sintered porous element 10 is greater than that of the sintered porous element 11. It is preferable that the porosity of the sintered porous element 10 falls within the range between 16 and 32 percent. This is because the electron emitting substance with which the porous element 10 is impregnated is excessively vaporized and lost in a short time if the porosity of the sintered porous element 10 is more than 32 percent and the life of the cathode is thereby reduced. In contrast, if the porosity is less than 16 percent, it is impossible to introduce the electron emitting substance to the sintered porous element and a supply of electron emitting substance to the surface of the cathode during operation is suppressed. The electron emission characteristic is thereby reduced.

Each vacancy in the sintered porous elements 10 and 11 is impregnated with any of barium oxide (BaO), a mixture of barium oxide, calcium oxide (CaO), and aluminum oxide ($Al_2O_3$), and so on as the electron emitting substance 1*a*.

In the impregnated cathode 1A, not only the sintered porous element 10 having the electron emitting region 10*a* but also the sintered porous element 11 corresponding to the region around the electron emitting region 10*a* is impregnated with the electron emitting substance 1*a*. In addition, the porosity of the electron emitting region 10*a* is greater than that of the sintered porous element 11. Consequently, the amount of the electron emitting substance la per unit volume contained in the sintered porous element 10 is greater than the one contained in the sintered porous element 11. As a result, emission of effective electrons from the electron emitting region 10*a* is performed steadily in a good condition. Furthermore, emission of unwanted electrons from the region other than the electron emitting region 10*a* is suppressed. Deposition of substances produced through evaporation of the electron emitting substance 1*a* onto the first grid 5 and the second grid 6 is suppressed as well. The characteristics such as the cathode cutoff voltage are thus maintained. The grid emission is reduced as well. The life of the electron gun is thereby increased.

The impregnated cathode 1A may be manufactured through the following steps.

FIG. 2A and FIG. 2B are cross sections of the impregnated cathode 1A of the embodiment of the invention each in the respective manufacturing steps. As shown in FIG. 2A, the sintered porous element 10 in the cylindrical shape, for example, whose porosity falls within the range between 16 and 32 percent, for example, and the sintered porous element 11, having the concave 11*a*, whose porosity is lower than that of the sintered porous element 10 are separately manufactured. The sintered porous elements 10 and 11 are each formed through pressing tungsten whose grain diameter is about 5 $\mu$m, for example, to form pellets and then heating and sintering the tungsten. The porosity is adjusted by controlling the pressure and the sintering temperature and duration. The sintered porous elements 10 and 11 are then fixed to each other. The fixing is performed by placing the sintered porous element 10 in the concave 11*a* of the sintered porous element 11 and fixing the sintered porous elements 10 and 11 to each other by sintering, press-fitting or welding.

Next, as shown in FIG. 2B, the sintered porous elements 10 and 11 are impregnated for about three minutes with the electron emitting substance 1*a* of barium oxide or a mixture of barium oxide, calcium oxide and aluminum oxide in a vacuum or in a hydrogen atmosphere by heating at about 1700° C., for example. The impregnated cathode 1A shown in FIG. 1 is thereby obtained.

According to the manufacturing method of the embodiment thus described, the two sintered porous elements 10 and 11 whose porosities are different from each other are fixed to each other. The sintered porous elements 10 and 11 are then impregnated with the electron emitting substance 1*a*. The impregnated cathode 1A wherein the amount of the electron emitting substance 1*a* per unit volume partly varies is thereby easily manufactured.

Figure 3A:
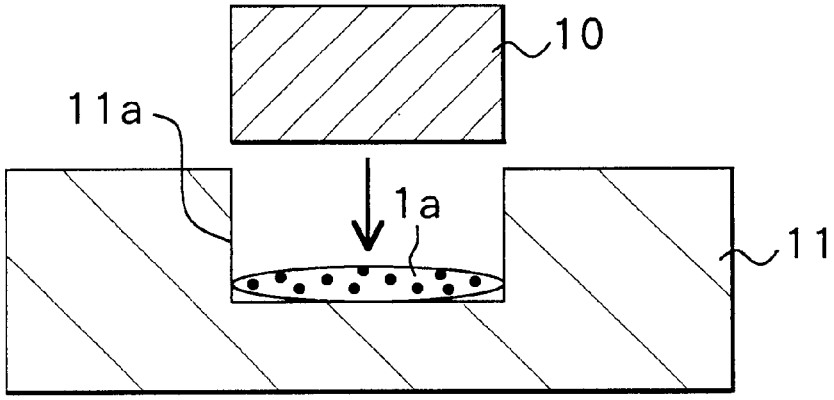
FIG. 3A and FIG. 3B are cross sections for illustrating another method of manufacturing the impregnated cathode of the first embodiment of the invention.
Figure 3B:
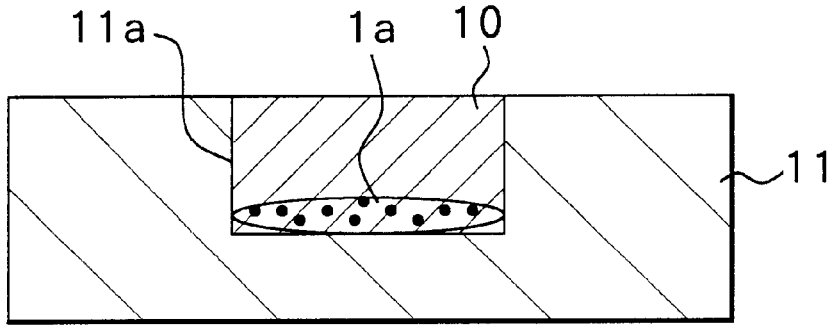

FIG. 3A and FIG. 3B are cross sections of the impregnated cathode 1A shown in FIG. 1 each in the respective manufacturing steps of another manufacturing method. Like numerals are assigned to the components similar to those shown in FIG. 2A and FIG. 2B. As shown in FIG. 3A, the sintered porous elements 10 and 11 whose porosities are different from each other are separately manufactured as in the method described above (FIG. 2A). The concave 11*a* of the sintered porous element 11 is then filled with the electron emitting substance 1*a*.

Next, as shown in FIG. 3B, the porous elements 10 and 11 are fixed to each other by a method such as placing the porous element 10 in the concave 11*a* of the porous element 11 and sintering the elements 10 and 11. The electron emitting substance 1*a* is then diffused into the porous elements 10 and 11 by heating at about 1700° C. (impregnation temperature), for example. The impregnated cathode 1A shown in FIG. 1 is thereby obtained.

According to the manufacturing method of the impregnated cathode 1A thus described, the two sintered porous elements 10 and 11 whose porosities are different from each other are fixed to each other so that the amount of the electron emitting substance 1*a* per unit volume is adjusted. In addition, the concave 11*a* of the sintered porous element 11 is filled with the electron emitting substance 1*a* before fixing the porous elements 10 and 11 to each other. As a result, the difference is reduced between the amount of the electron emitting substance 1*a* intended for impregnation and the amount actually introduced to the porous elements 10 and 11.

Second Embodiment

A second embodiment of the invention will now be described. Like numerals are assigned to the components similar to those of the first embodiment and detailed descriptions thereof are omitted.

FIG. 6 is a cross section of an impregnated cathode 1B of the second embodiment. Basically, as in the first embodiment, the impregnated cathode 1B is placed directly beneath the electron emission hole 5*a* of the first grid 5 and the electron emission hole 6*a* of the second grid 6. The impregnated cathode 1B is made up of a sintered porous element 20 as a first porous element whose surface functions as an electron emitting region 20*a* and a sintered porous element 21 as a second porous element whose surface is a peripheral region other than the electron emitting region. In the second embodiment, in contrast to the first embodiment, the surface of the sintered porous element 21 is ground with alumina ($Al_2O_3$) or diamond (C) powder so that the pores of the sintered element are destroyed to form a nonporous surface 21*a*.

Since the surface of the sintered porous element 21 of the impregnated cathode 1B is ground so as to form the nonporous surface 21*a*, the nonporous surface 21*a* is not impregnated with the electron emitting substance such as barium oxide. In addition, the nonporous surface 21*a* suppresses evaporation of barium oxide staying in the sintered porous element 21 and reduced barium from the surface. Consequently, as in the first embodiment, emission of effective electrons from the electron emitting region 20*a* is performed steadily in a good condition, regardless of the porosities of the sintered porous elements 20 and 21. Deposition of barium oxide and reduced barium onto the first grid 5 and the second grid 6 is suppressed as well. The porosity of the sintered porous element 21 is preferably 27 percent or below. In the second embodiment, the ratio between the porosity of the sintered porous element 20 and that of the sintered porous element 21 may be arbitrarily determined.

FIG. 7A and FIG. 7B are cross sections showing the manufacturing steps of the impregnated cathode 1B. As shown in FIG. 7A, the sintered porous elements 20 and 21 are separately manufactured as in the first embodiment. The surface of the sintered porous elements 21 is then ground with alumina or diamond powder to form the non-porous surface 21*a*. Next, as in the first embodiment, the sintered porous elements 20 and 21 are fixed to each other. As shown in FIG. 7B, the sintered porous elements 20 and 21 are impregnated with the electron emitting substance 1*a* such as barium oxide. The impregnated cathode 1B shown in FIG. 6 is thereby obtained.

Third Embodiment

Figure 8:
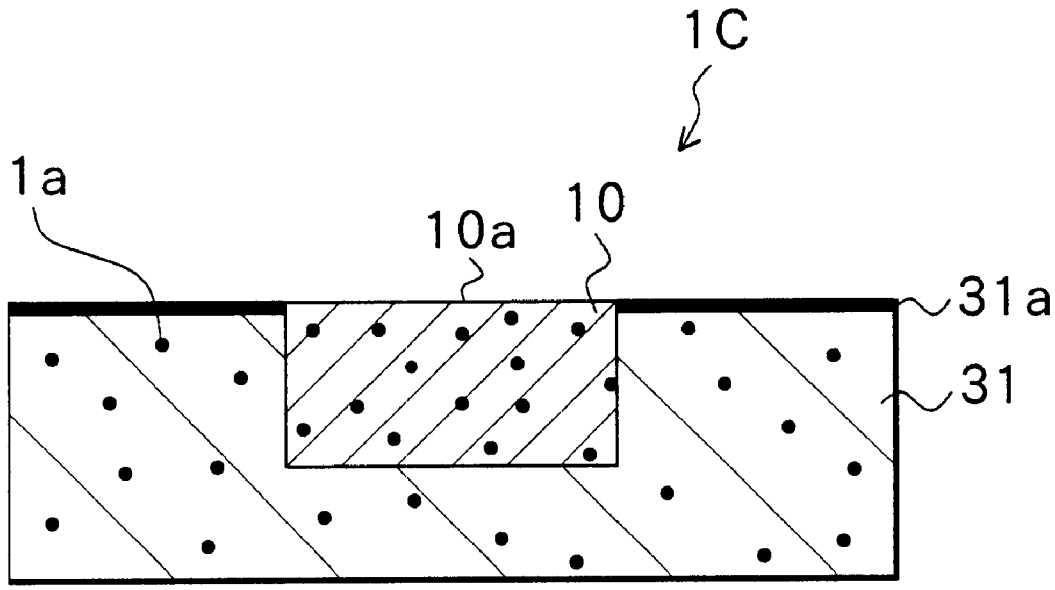
FIG. 8 is a cross section of an impregnated cathode of a third embodiment of the invention.

FIG. 8 is a cross section of an impregnated cathode 1C of a third embodiment of the invention. The impregnated cathode 1C is made up of a sintered porous element 10 as a first porous element having an electron emitting region 10*a* and a sintered porous element 31 as a second porous element having a nonporous surface 31*a*, the porous elements 10 and 31 being integrated with each other. The porosity of the sintered porous element 31 is lower than that of the sintered porous element 10. As in the first embodiment, the porosity of the sintered porous element 10 falls within the range between 16 and 32 percent. As in the second embodiment, the porosity of the sintered porous element 31 is preferably 27 percent or below.

The impregnated cathode 1C may be manufactured by separately forming the sintered porous elements 10 and 31 whose porosities are different from each other and grinding the surface of the sintered porous element 31 as in the second embodiment to form the nonporous surface 31*a*. The sintered porous elements 10 and 31 are then impregnated with the electron emitting substance 1*a*.

In the impregnated cathode 1C, the porosity of the sintered porous element 10 is greater than that of the sintered porous element 31. Consequently, the amount of the electron emitting substance 1*a* per unit volume contained in the porous element 10 is greater than that in the porous element 31. As a result, emission of effective electrons is performed steadily in a good condition. Furthermore, emission of unwanted electrons from the sintered porous element 31 is suppressed since the surface of the sintered porous element 31 is the nonporous surface 31*a*. Deposition of substances produced through evaporation of the electron emitting substance 1*a* onto the first grid 5 and the second grid 6 is suppressed as well.

Fourth Embodiment

Figure 9:
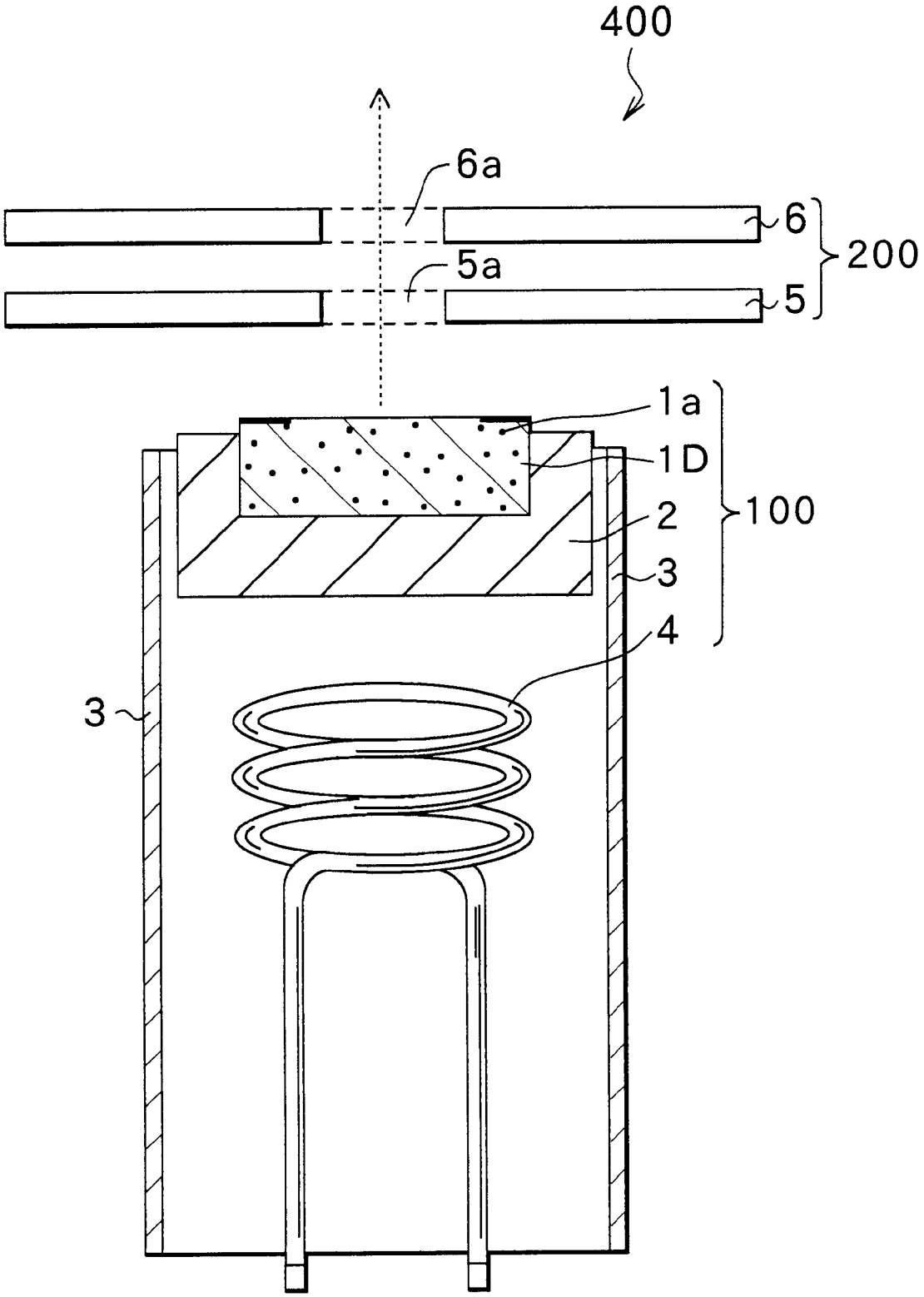
FIG. 9 is a cross section of an electron gun using the impregnated cathode of a fourth embodiment of the invention.

FIG. 9 is a schematic view of an electron gun 400 including an impregnated cathode of a fourth embodiment of the invention. The electron gun 400 may be applied to the cathode-ray tube shown in FIG. 4 mentioned above. The configuration of the electron gun 400 is similar to that of the electron gun 300 of the first embodiment except that the impregnated cathode 1A is replaced with an impregnated cathode 1D. Like numerals are assigned to the components similar to those of the electron gun 300 and detailed descriptions thereof are omitted.

Figure 10A:
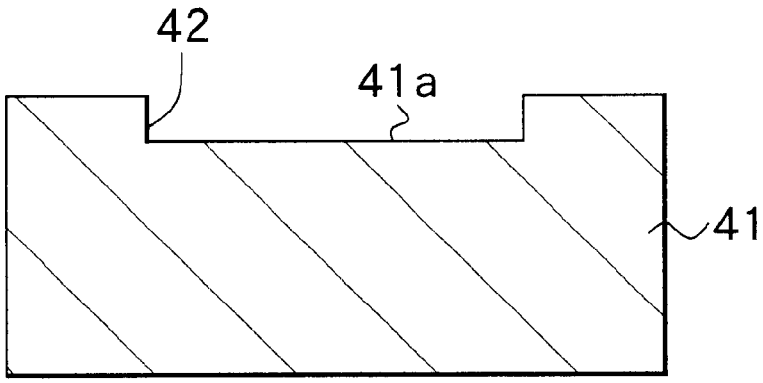
FIG. 10A, FIG. 10B and FIG. 10C are cross sections for illustrating a method of manufacturing the impregnated cathode of the fourth embodiment of the invention.
Figure 10B:
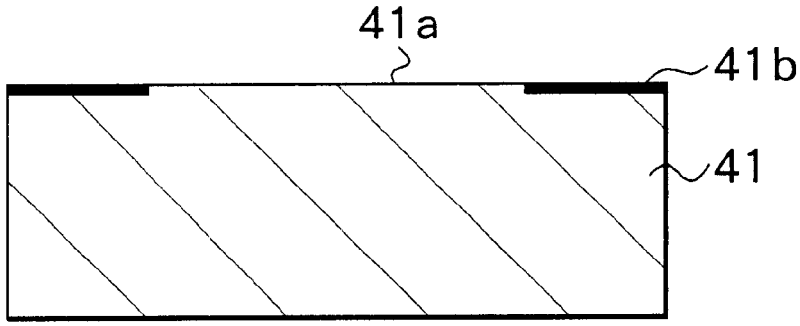
Figure 10C:
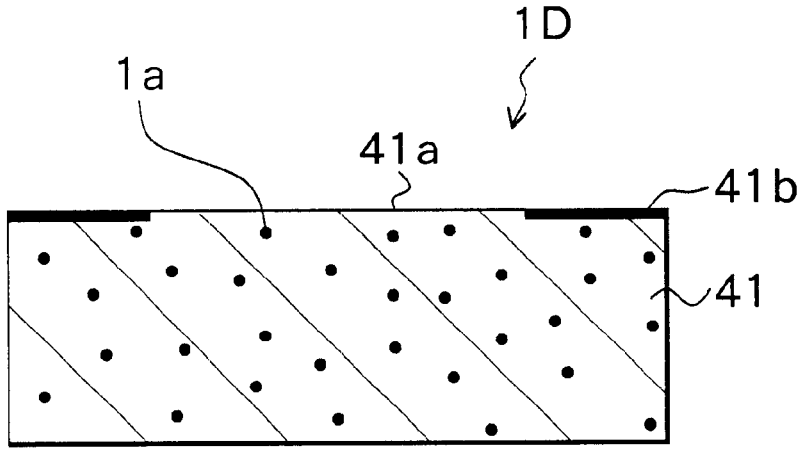

FIG. 10C shows only the impregnated cathode 1D in the electron gun 400 shown in FIG. 9. The impregnated cathode 1D is placed directly beneath the electron emission hole 5*a* of the first grid 5 and the electron emission hole 6*a* of the second grid 6. The impregnated cathode 1D is made up of a sintered porous element 40 of a conductive material such as tungsten (W) or molybdenum (Mo). That is, the impregnated cathode 1D is made of a single-piece structure, in contrast to the impregnated cathodes 1A to 1C.

The sintered porous element 41 has a cylindrical shape, for example. The diameter thereof is 1.6 mm, for example. The surface of the sintered porous element 41 is made of an electron emitting region 41*a* and a nonporous surface 41*b* other than the electron emitting region 41*a*. The diameter of the electron emitting region 41*a* may be 0.9 mm, for example, that is, slightly greater than that of each of the electron emission holes 5*a* and 6*a* of the first grid 5 and the second grid 6, respectively.

As in the second and third embodiment, the nonporous surface 41*b* is ground with alumina, diamond powder or abrasive paper so that the pores of the sintered element are destroyed.

The porosity of the sintered porous element 41 preferably falls within the range between 16 and 32 percent. The reason is the same as the reason described in the first embodiment.

Each vacancy in the sintered porous element 41 is impregnated with any of barium oxide (BaO), a mixture of barium oxide, calcium oxide (CaO), and aluminum oxide ($Al_2O_3$), and so on as the electron emitting substance 1*a*.

In the impregnated cathode 1D, the pores of the sintered element are destroyed in the nonporous surface 41*b* and the nonporous surface 41*a* is not impregnated with the electron emitting substance 1*a*. In addition, emission of unwanted electrons from the nonporous surface 41*b* is suppressed. Consequently, emission of effective electrons from the electron emitting region 20*a* is performed steadily in a good condition. Deposition of the electron emitting substance 1*a* onto the first grid 5 and the second grid 6 is suppressed as well. Furthermore, since the whole sintered porous element 41 is impregnated with the electron emitting substance 1*a*, the amount of the electron emitting substance 1*a* sufficient for obtaining the steady electron emission characteristic is maintained in the cathode.

Referring to FIG. 10A, FIG. 10B and FIG. 10C, a method of manufacturing the impregnated cathode 1D will now be described.

As shown in FIG. 10A, tungsten powder whose grain diameter is 3 $\mu$m, a binder made of an organic compound, for example, and water are mixed by a stirrer to form slurry. Using the slurry, granulated powder of about 50 $\mu$m is made by the spray dryer method, for example. The granulated powder is fed into a mold, pressed with a pressure of 5 tons/cm$^2$, and heated in a hydrogen-reducing atmosphere, for example, to remove the binder. The granulated powder is further heated for three hours at a temperature of 1800° C., for example, in a hydrogen atmosphere or an inert gas atmosphere to sinter the granulated powder. The cylindrical sintered porous element 41 is thereby obtained. The sintered porous element 41 has a step 42 in the shape of concave, for example, and includes the electron emitting region 41*a* on the surface thereof.

The porosity of the sintered porous element 41 is controlled by the pressure and the sintering temperature and duration. The porosity is constant throughout the sintered porous element 41 and may be 25 percent, for example. The thickness of the sintered porous element 41 may be 0.65 mm. The diameter of the step 42 may be 0.9 mm. The step height may be 0.05 mm.

As shown in FIG. 10B, the surface of the sintered porous element 41 other than the electron emitting region 41*a* is ground with fine abrasive paper of number 2000, for example, to destroy the pores of the sintered element and form the nonporous surface 41*b*. It is preferable that the surface is ground so that the step between the electron emitting region 41*a* and the nonporous surface 41*b* is 10 $\mu$m or below. It is more preferable that the step is 5 $\mu$m or below. This is because the step of more than 10 $\mu$m makes the electron emission characteristic unsteady and makes it difficult to correctly align the distance between the impregnated cathode 1D and the first grid 5 for assembling the electron gun 400. The sintered porous element 41 may be ground with alumina or diamond powder instead of abrasive paper. Alternatively, a plurality of the sintered porous elements 41 may be placed on a disk-shaped jig and ground by a rotary lapping machine.

Next, the sintered porous element 41 is impregnated with the electron emitting substance 1*a* of barium oxide (BaO) or a mixture of barium oxide, calcium oxide (CaO) and aluminum oxide in a vacuum or in a hydrogen atmosphere by heating and melting. The impregnated cathode 1D shown in FIG. 10C is thereby obtained.

In the embodiment thus described, the sintered porous element 41 having the step 42 is formed and the step 42 is then ground to form the nonporous surface 41*b*. The sintered porous element 41 is then impregnated with the electron emitting substance 1*a*. As a result, the impregnated cathode ID allows emission of effective electrons from the electron emitting region 20*a* to be performed steadily in a good condition. Deposition of the electron emitting substance la onto the first grid 5 and the second grid 6 is suppressed as well. The impregnated cathode 1D is easily manufactured at low cost.

Fifth Embodiment

Figure 11:
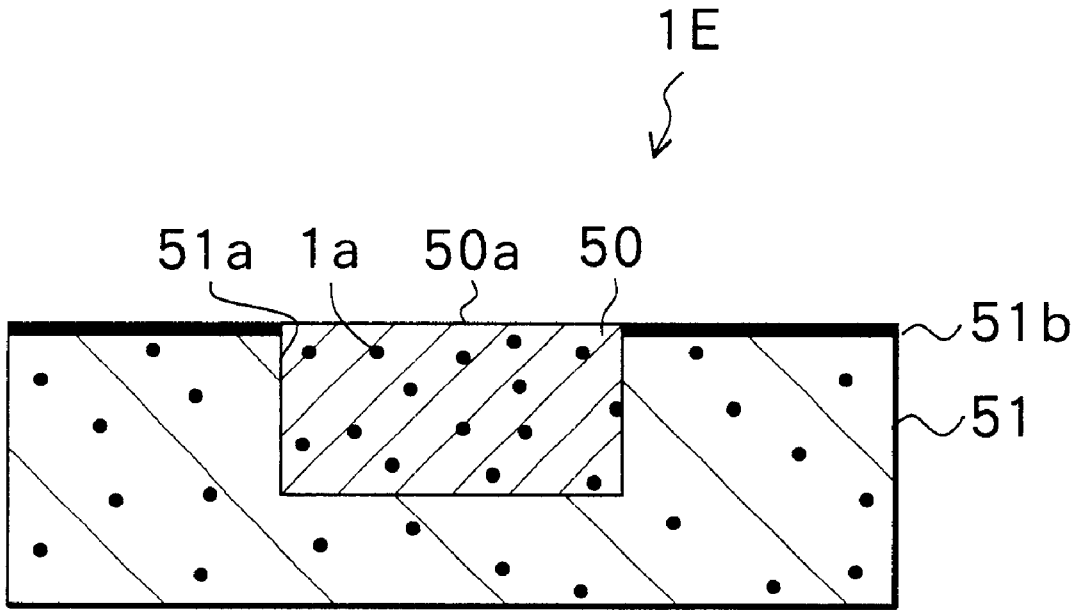
FIG. 11 is a cross section of an impregnated cathode of a fifth embodiment of the invention.

FIG. 11 is a cross section of an impregnated cathode 1E of a fifth embodiment of the invention. The impregnated cathode 1E may be incorporated in the electron gun 300 shown in FIG. 5. The impregnated cathode 1E is placed directly beneath the electron emission hole 5*a* of the first grid 5 and the electron emission hole 6*a* of the second grid 6, being incorporated in the electron gun 300.

The impregnated cathode 1E is made of two conductive porous elements whose shrinkage factors are different from each other. For example, the impregnated cathode 1E is made of a sintered porous element 50 as a first porous element whose surface functions as an electron emitting region 50*a* and a sintered porous element 51 as a second porous element whose surface is a peripheral region other than the electron emitting region and whose shrinkage factor is greater than that of the porous element 50.

The sintered porous element 50 may be 0.895 mm in diameter and 0.33 mm in thickness and take a cylindrical shape with a diameter slightly greater than that of each of the electron emission holes 5*a* and 6*a* of the first grid 5 and the second grid 6, respectively. The sintered porous element 51 has a concave 51*a* in which the sintered porous element 50 is placed. The surface of the sintered porous element 51 other than the concave 51*a* is ground and the pores are destroyed to form a nonporous surface 51*b*. The sintered porous element 51 may be 1.440 mm in diameter and 0.6 mm in thickness. The sintered porous element 50 being fitted and fixed to the concave 51*a* of the porous element 50 by sintering, the surfaces of the sintered porous elements 50 and 51 are both in one plane.

The porosity of the sintered porous element 50 preferably falls within the range between 16 and 32 percent. This is because the electron emitting substance with which the porous element 50 is impregnated is excessively vaporized and lost in a short time if the porosity of the sintered porous element 50 is more than 32 percent and the life of the cathode is thereby reduced. In contrast, if the porosity is less than 16 percent, it is impossible to introduce the electron emitting substance to the sintered porous element and a supply of electron emitting substance to the surface of the cathode during operation is suppressed. The electron emission characteristic is thereby reduced.

Each vacancy in the sintered porous elements 50 and 51 is impregnated with any of barium oxide, a mixture of barium oxide, calcium oxide, and aluminum oxide, and so on as the electron emitting substance 1*a*.

Referring to FIG. 12A, FIG. 12B, FIG. 12C and FIG. 12D, a method of manufacturing the impregnated cathode 1E will now be described.

Figure 12A:
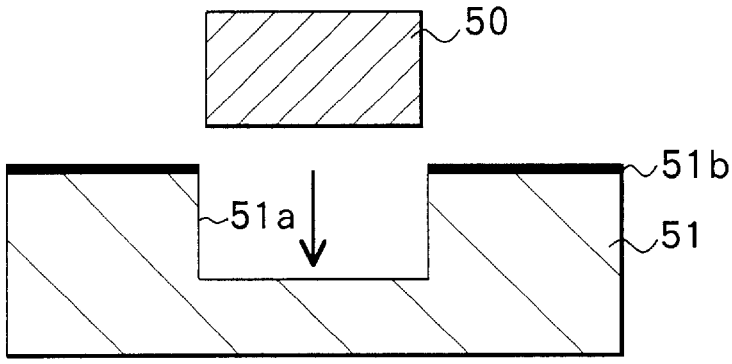
FIG. 12A, FIG. 12B, FIG. 12C and FIG. 12D are cross sections for illustrating a method of manufacturing the impregnated cathode of the fifth embodiment of the invention.

As shown in FIG. 12A, the sintered porous element 50 and the sintered porous element 51 with the concave 51*a* are each formed. The sintered porous element 50 may have a density of 14.5 g/cm$^3$, a diameter of 0.895 mm, a thickness of 0.330 mm. The sintered porous element 51 may have a density of 13.4 g/cm$^3$, a diameter of 1.471 mm, a thickness of 0.640 mm and has a shrinkage factor greater than that of the sintered porous element 50. To form both sintered porous elements 50 and 51, a refractory metal (such as tungsten powder whose grain diameter is 3 $\mu$m), a binder made of an organic compound, for example, and water are mixed by a stirrer to form slurry. Using the slurry, granulated powder of about 50 $\mu$m is made by the spray dryer method, for example. To form the sintered porous element 50, the granulated powder is fed into a mold, pressed with a pressure of 5 tons/cm$^2$, and heated at a temperature of 1800° C. in a hydrogen atmosphere for three hours, for example, so that the granulated powder is sintered (provisional sintering). To form the sintered porous element 51, the granulated powder is fed into a mold, pressed with a pressure of 2 tons/cm$^2$, and heated in a hydrogen atmosphere for three hours at a temperature of 1700° C., for example, so that the granulated powder is sintered provisional sintering). The concave 51*a* is formed to have a diameter of 0.916 mm, for example, so that the diameter is greater than that of the sintered porous element 50.

The densities of the sintered porous elements 50 and 51 are controlled by varying the pressure for molding.

Next, the surface of the sintered porous element 51 is ground with fine abrasive paper of number 2000, for example, to destroy the pores of the sintered element and form the nonporous surface 51*b*. The thickness of the sintered porous element 51 is reduced, compared to the thickness before grinding, down to 0.610 mm, for example. As in the fourth embodiment, the sintered porous element 51 may be ground with alumina, diamond powder or by a lapping machine instead of abrasive paper.

Figure 12B:
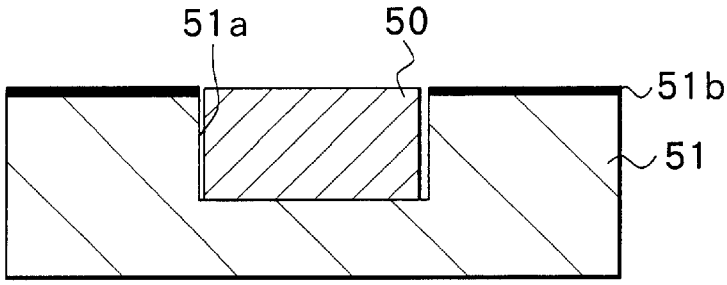

As shown in FIG. 12B, the sintered porous element 50 is inserted to the concave 51*a* of the sintered porous element 51. The sintered porous elements 50 and 51 are heated at a temperature of 1800° C. in a hydrogen atmosphere for three hours, for example, and sintered (finish sintering). The sintered porous elements 50 and 51 are thereby fixed to and integrated with each other (a fixing step).

The sintered porous element 50 shrinks by 9.1 percent in diameter and 7.9 percent in thickness, for example. The sintered porous element 51 shrinks by 10.5 percent in diameter and 10.3 percent in thickness, for example. That is, the shrinkage factor of the sintered porous element 50 is lower than that of the sintered porous element 51. The shrinkage factors are adjusted by controlling the densities of the sintered porous elements 50 and 51 previously described or by controlling the temperature (for sintering) and the heating duration (sintering duration).

Figure 12C:
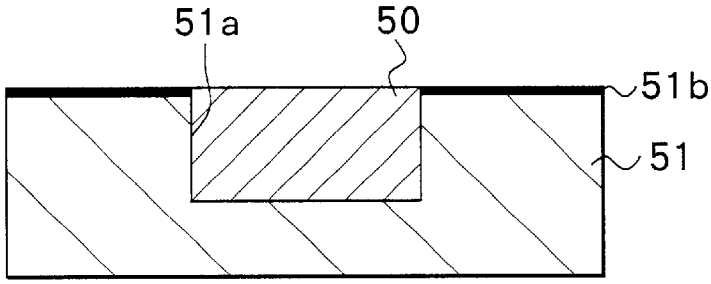

As shown in FIG. 12C, the surfaces of the sintered porous elements 50 and 51 are in one plane and the sintered porous element 50 is fitted to the concave 51*a* of the sintered porous element 51 with no clearance. The fixed sintered porous element 50 and the concave 51*a* are 0.882 mm in diameter and 0.30 mm in thickness (height), for example. The fixed sintered porous element 51 is 1.440 mm in diameter and 0.600 mm in thickness, for example.

Figure 12D:
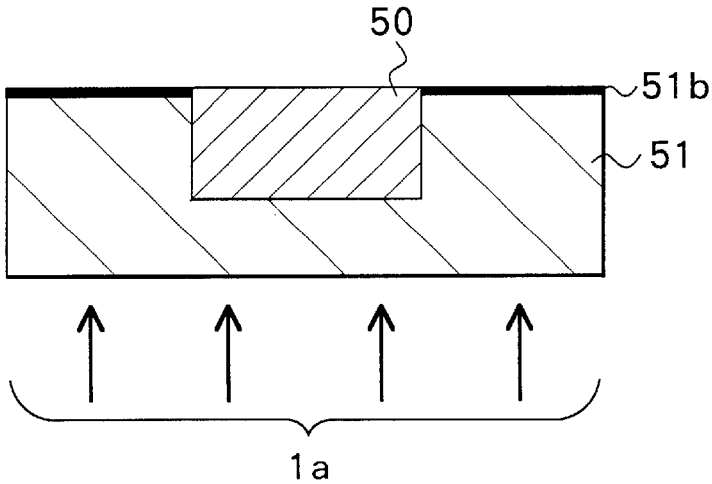

Next, as shown in FIG. 12D, the sintered porous elements 50 and 51 are impregnated with the electron emitting substance 1*a* of barium oxide or a mixture of barium oxide, calcium oxide and aluminum oxide in a vacuum or in a hydrogen atmosphere by heating and melting. The impregnated cathode 1E shown in FIG. 11 is thereby obtained.

According to the fifth embodiment thus described, the sintered porous elements 50 and 51 are integrated with each other by sintering. As a result, the sintered porous elements 50 and 51 will not be damaged while being integrated. The yields during manufacturing will be therefore dramatically improved.

Since no clearance is formed in the interface between the sintered porous elements 50 and 51, there is no possibility that the electron emitting substance 1*a* remains in such clearance and seeps out of the surface of the impregnated cathode 1E or a great amount of the electron emitting substance 1*a* instantaneously evaporates while the cathode is heated. As a result, the electron emission characteristic is improved and the life of the impregnated cathode is increased.

EXAMPLES

First Example

Practical examples of the invention will now be described. The electron gun 300 comprising the impregnated cathode 1A having the configuration described in the first embodiment will be described in a first example below.

Tungsten whose grain diameter was about 5 μm was pressed to form pellets and heated at a temperature of 1800° C. and sintered. The sintered porous element 10 whose porosity was 20 percent and the sintered porous element 11 whose porosity was 15 percent were thereby formed. Next, the sintered porous element 10 was press-fitted into the concave 11*a* of the sintered porous element 11 and the sintered porous elements 10 and 11 were impregnated with barium oxide as the electron emitting substance for about three minutes by heating at a temperature of about 1700° C. The impregnated cathode 1A was thereby obtained.

The amounts of barium oxide contained in the sintered porous elements 10 and 11 of the impregnated cathode 1A thus obtained were measured. Assuming that the amount contained in the sintered porous element 10 was 100 percent, the amount contained in the sintered porous elements 11 was 55 percent. That is, the amount of particles including barium emitted from the sintered porous element 10 towards the first grid was reduced to about half the amount obtained in a cathode of related art.

The impregnated cathode 1A being incorporated in a cathode-ray tube, a reliability test for 2000 to 5000 hours was performed, that is, the cathode cutoff voltage and grid emission were determined. The result was that the drift of the cathode cutoff voltage was reduced to a fourth of the drift of the related-art cathode and the amount of the grid emission was reduced to a fourth of the amount of the related-art cathode. The reduction rate of the pulse emission characteristic determined in the reliability test was low and favorable. As a result, the impregnated cathode 1A and the electron gun 300 obtained in the example exhibited excellent reliability in reducing the cathode cutoff voltage, the grid emission and so on and had the excellent electron emission characteristic.

Second Example

An example of the electron gun 400 comprising the impregnated cathode 1D having the configuration described in the fourth embodiment will now be described.

Tungsten powder whose grain diameter is 3 μm, an organic binder, and water were mixed by a stirrer to form slurry. Using the slurry, granulated powder of about 50 μm was made by the spray dryer method. The granulated powder was fed into a mold, pressed with a pressure of 5 tons/cm$^2$, and heated in a hydrogen-reducing atmosphere to remove the organic binder. The granulated powder was further heated at a temperature of 1800° C. in a vacuum for three hours. The cylindrical sintered porous element 41 was thereby obtained. The sintered porous element 41 had the step 42 of 0.9 mm in diameter and 0.05 mm in step height on the surface thereof. The porosity of the sintered porous element 41 measured was 25 percent.

The step 42 was ground with abrasive paper of number 2000 so that the surface of the sintered porous element 41 was nearly flat. The sintered porous element 41 whose surface was made up of the electron emitting region 41*a* and the nonporous surface 41*b* were thereby obtained. The surface of the sintered porous element 41 being observed by a scanning electron microscope (SEM), the pores of the sintered element of the nonporous surface 41*b* were found to be destroyed and lost.

Next, the sintered porous element 41 was impregnated with the electron emitting substance 1*a* of a mixture of barium carbonate ($BaCO_3$), calcium carbonate ($CaCO_3$) and aluminum oxide ($Al_2O_3$) whose mole ratio was 4:1:1 in a vacuum by heating and melting. The impregnated cathode 1D was thereby obtained. The electron gun 400 was assembled with the impregnated cathode 1D and installed in the cathode-ray tube.

To compare with the impregnated cathode of the example of the invention, a cylindrical sintered porous element whose surface was flat, that is, having no concave was made and an impregnated cathode was formed under conditions similar to those of the example of the invention except that the surface was not ground. An electron gun was assembled with the impregnated cathode and installed in a cathode-ray tube.

Using the cathode-ray tubes of the example of the invention and the comparison example, a reliability test for 5000 hours was performed. The result was that the drift of the cathode cutoff voltage obtained with the cathode-ray tube of the example of the invention was 20 percent or below of the drift obtained with the cathode-ray tube of the comparison example. With the cathode-ray tube of the example of the invention, generation of the grid emission was prevented as well. Furthermore, the cathode-ray tubes of the example of the invention and the comparison example were disassembled after the test and the amount of deposits such as barium on the surfaces of the first and second grids were observed. The amount of deposits found in the cathode-ray tube of the example of the invention was 20 percent or below of that found in the cathode-ray tube of the comparison example. As a result, the cathode-ray tube and the electron gun obtained in the example of the invention exhibited excellent reliability in reducing the cathode cutoff voltage, the grid emission and so on and had the excellent electron emission characteristic.

Third Example

An example of an electron gun comprising the impregnated cathode IE having the configuration described in the fifth embodiment will now be described.

Tungsten powder whose grain diameter was 3 μm, an organic binder, and water were mixed by a stirrer to form slurry. Using the slurry, granulated powder of about 50 μm was made by the spray dryer method.

The granulated powder was fed into a mold, pressed with a pressure of 5 tons/cm$^2$ to mold and heated at a temperature of 1800° C. in a hydrogen atmosphere for three hours to sinter the granulated powder and form the sintered porous element 50. The sintered porous element 50 had a density of 14.5 g/cm$^3$, a diameter of 0.895 mm, and a thickness of 0.330 mm.

The granulated powder described above was fed into a mold, pressed with a pressure of 2 tons/cm$^2$ to mold and heated at a temperature of 1700° C. in a hydrogen atmosphere for three hours to sinter the granulated powder and form the sintered porous element 51 having the concave 51*a*. The sintered porous element 51 had a density of 13.4 g/cm$^3$, a diameter of 1.471 mm, and a thickness of 0.640 mm. The diameter of the concave 51*a* was 0.916 mm.

The surface of the sintered porous element 51 was ground with abrasive paper of number 2000 to form the nonporous surface 51*b*. The thickness of the sintered porous element 51 was 0.610 mm.

Next, the sintered porous element 50 was inserted to the concave 51*a* of the sintered porous element 51 and the sintered porous elements 50 and 51 were heated at a temperature of 1800° C. in a hydrogen atmosphere for three hours to sinter. Furthermore, the sintered porous elements 50 and 51 were impregnated with the electron emitting substance 1*a* of a mixture of barium carbonate ($BaCO_3$), calcium carbonate ($CaCO_3$) and aluminum oxide ($Al_2O_3$) whose mole ratio was 4:1:1 in a vacuum by heating and melting. The impregnated cathode 1E was thereby obtained. The electron gun was assembled with the impregnated cathode 1E and installed in the cathode-ray tube.

An impregnated cathode to compare with the impregnated cathode of the example of the invention was manufactured by sintering the porous elements 50 and 51 separately by heating at a temperature of 1800° C. in a hydrogen atmosphere for three hours before inserting the porous element 50 to the concave 51*a* of the porous element 50. The sintered porous elements 50 and 51 were then fixed to each other by press-fitting. An electron gun was assembled with the impregnated cathode and installed in a cathode-ray tube. The remainder of the conditions for the comparison example were similar to those for the example of the invention.

Using the cathode-ray tubes of the example of the invention and the comparison example, a reliability test for 5000 hours was performed. The result was that the drift of the cathode cutoff voltage obtained with the cathode-ray tube of the example of the invention was 20 percent or below of the drift obtained with the cathode-ray tube of the comparison example. With the cathode-ray tube of the example of the invention, generation of the grid emission was prevented as well. Furthermore, the cathode-ray tubes of the example of the invention and the comparison example were disassembled after the test and the amount of deposits such as barium on the surfaces of the first and second grids were observed. The amount of deposits found in the cathode-ray tube of the example of the invention was 20 percent or below of that found in the cathode-ray tube of the comparison example. As a result, the cathode-ray tube and the electron gun obtained in the example of the invention exhibited excellent reliability in reducing the cathode cutoff voltage, the grid emission and so on and had the excellent electron emission characteristic.

The invention is not limited to the embodiments and examples described so far but may be practiced in still other ways. For example, although the first and second porous elements are fixed to each other and then impregnated with the electron emitting substance from outside in the foregoing second and third embodiments, the method of the first embodiment wherein the concave of the second porous element is filled with the electron emitting substance in advance and heated and the substance is diffused may be applied to the second and third embodiments.

Although the porous elements were made of tungsten as a refractory metal in the foregoing embodiments, any other material such as molybdenum (Mo) that satisfies the following conditions is applicable. That is, the material is conductive, capable of reducing an electron emitting substance such as barium oxide, has an appropriate work function, has a melting point high enough to withstand the cathode operating temperature (about 1000° C. for an impregnated cathode) and an aging temperature (about 1200 to 1300° C.) transiently high during the step of fabricating a cathode-ray tube and so on, and is capable of forming a porous element by sintering.

Although the invention is applied to the cathode-ray tube in the foregoing embodiments, the invention may be applied to any other electron tube in general including a microwave tube.

Figure 13:
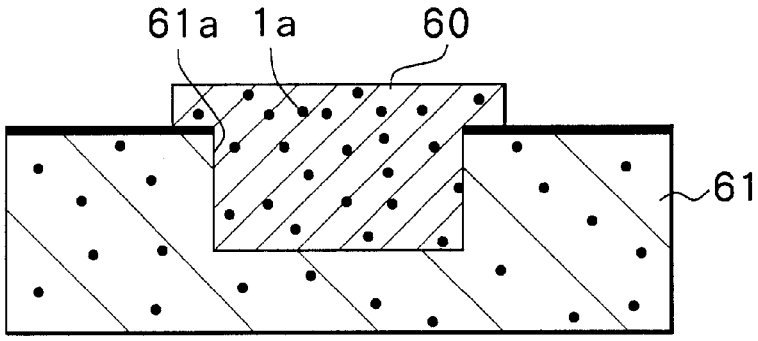
FIG. 13 is a cross section of an impregnated cathode of a modification example of the first to fifth embodiments of the invention.

In the foregoing embodiments, the surface of the sintered porous element having the electron emitting region and the surface of the sintered porous element around the electron emitting region are both in one plane. Alternatively, as shown in FIG. 13, a sintered porous element 60 in the shape of wedge whose upper part is larger in diameter than a concave 61*a* of a sintered porous element 61 may be provided. The surface of the sintered porous elements 60 and 61 thus takes the form of step.

Figure 14:
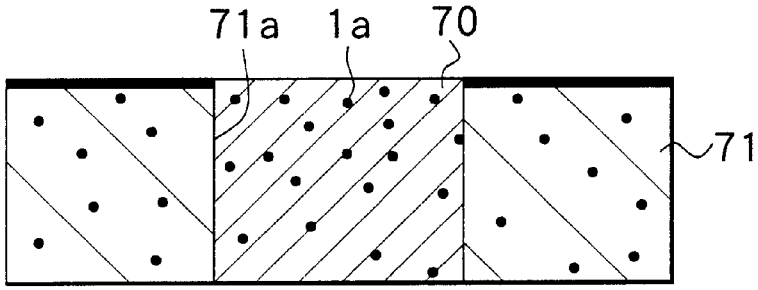
FIG. 14 is a cross section of an impregnated cathode of a modification example of the first to fifth embodiments of the invention.
Figure 15:
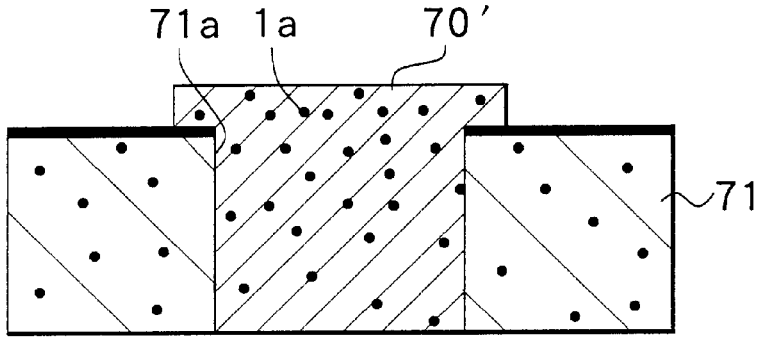
FIG. 15 is a cross section of an impregnated cathode of another modification example of the first to fifth embodiments of the invention.

In the foregoing embodiments, the sintered porous element around the electron emitting region has the concave. Alternatively, as shown in FIG. 14, a sintered porous element 71 to be the region around the electron emitting region, having a through hole 71*a* may be provided. A cylindrical sintered porous element 70 is inserted to the sintered porous element 71. As shown in FIG. 15, another alternative is that a wedge-shaped sintered porous element 70' as described above may be inserted to the sintered porous element 71.

Figure 16:
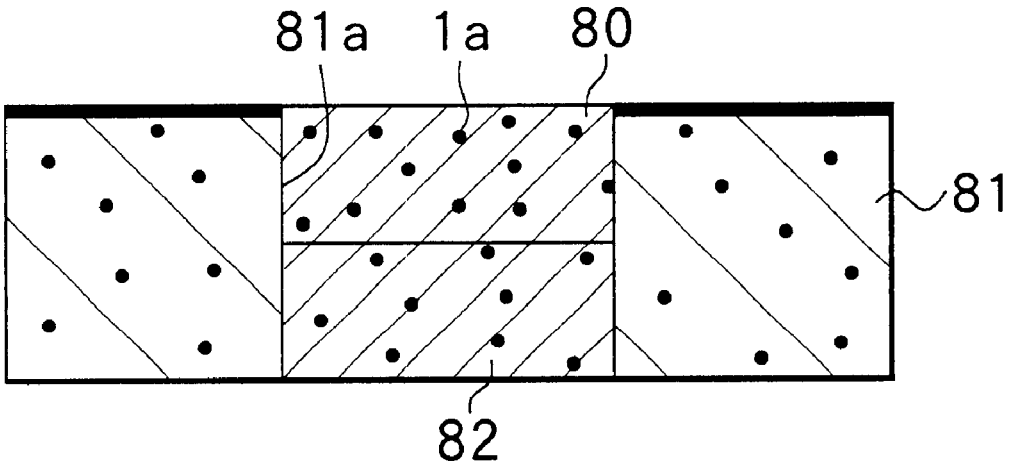
FIG. 16 is a cross section of an impregnated cathode of still another modification example of the first to fifth embodiments of the invention.
Figure 17:
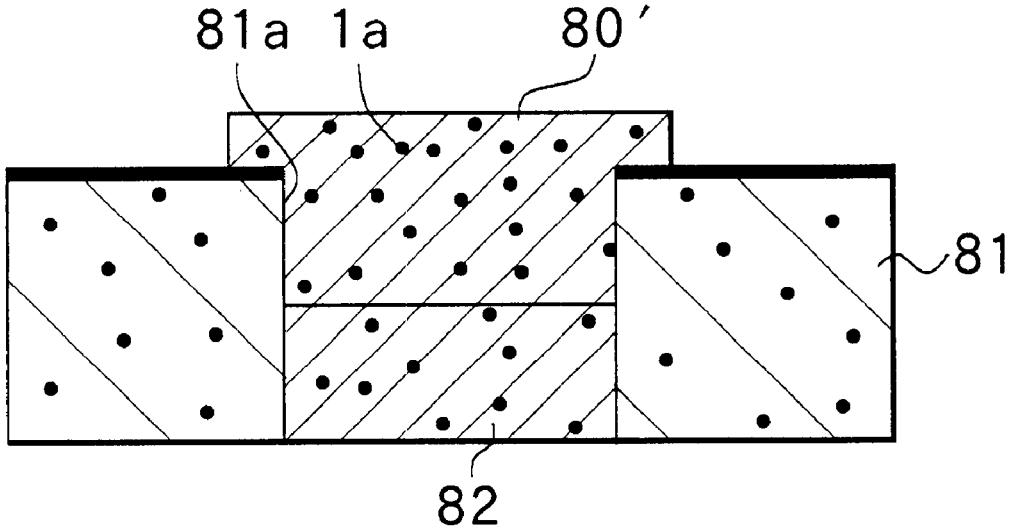
FIG. 17 is a cross section of an impregnated cathode of still another modification example of the first to fifth embodiments of the invention.

Although the impregnated cathode is made of one or two sintered porous elements in the foregoing embodiments, the cathode may be made of more than two elements. As shown in FIG. 16, such cathode may comprise a sintered porous element 81 to be the region around the electron emitting region, having a through hole 81*a*, a sintered porous element 82 inserted to the through hole 81*a* and a sintered porous element 80 having the electron emitting region. As shown in FIG. 17, such cathode may comprise three sintered porous elements 80', 81 and 82. The sintered porous element 80' having the electron emitting region takes a shape of wedge.

According to the impregnated cathode, the electron gun and the electron tube of the invention described so far, the porosity of part corresponding to the electron emitting region of the porous element and the porosity of part corresponding to the peripheral region are different from each other. As a result, emission of electrons from the electron emitting region is steadily and sufficiently performed. Emission of unwanted electrons from the region whose porosity is greater is suppressed and deposition of substances resulting from excess electron emitting substances and so on onto the grid is suppressed. The drift of cathode cutoff voltage and the grid emission are thereby reduced. Since the electron emitting region and the peripheral region are made of porous elements, the electron emitting substance is stored in any region. As a result, the characteristics of electron emission from all the surface of the temperature-limited region such as the pulse emission characteristic are maintained without reducing the life of the impregnated cathode.

According to the other impregnated cathode, electron gun and electron tube of the invention, the nonporous surface is provided in the peripheral region of the porous element. Emission of unwanted electrons from the peripheral region is suppressed and deposition of substances resulting from excess electron emitting substances and so on onto the grid is suppressed.

According to still the other impregnated cathode of the invention, the shrinkage factors of the plurality of porous elements are different from one another. As a result, no clearance is formed in the interface between the sintered porous elements during manufacturing. There is no possibility that the electron emitting substance seeps out of the surface of the impregnated cathode or a great amount of the electron emitting substance instantaneously evaporates while the cathode is heated. As a result, the electron emission characteristic is improved and the life of the impregnated cathode is increased.

According to the method of manufacturing an impregnated cathode of the invention, the impregnated cathode described above is easily manufactured.

In particular, the method of manufacturing an impregnated cathode of the invention offers the simple manufacturing steps and reduces manufacturing costs.

According to the other method of manufacturing an impregnated cathode of the invention, the plurality of porous elements whose shrinkage factors are different from one another are fixed to one another by sintering. As a result, the porous elements will not be damaged while being integrated. The yields during manufacturing will be therefore improved.

Obviously many modifications and variations of the present invention are possible in the light of the above teachings. It is therefore to be understood that within the scope of the appended claims the invention may be practiced otherwise than as specifically described.

What is claimed is:

1. A method of manufacturing an impregnated cathode, including the steps of:

fabricating a conductive porous element including part corresponding to an electron emitting region and part corresponding to a peripheral region other than the electron emitting region in a surface of the porous element;

grinding the part corresponding to the peripheral region of the porous element to form a nonporous surface; and having the porous element impregnated with an electron emitting substance.

2. A method according to claim 1 wherein a step is formed in the step of fabricating the porous element so that the part corresponding to the peripheral region of the porous element is at the top of the step and the part corresponding to the electron emitting region is at the bottom of the step.

3. A method according to claim 2 wherein the grinding is performed so that the step height between the electron emitting region and the peripheral region is 10 $\mu$m or below.

4. A method according to claim 1 wherein the porous element is fabricated by sintering metal powder in the step of fabricating the porous element.

5. A method according to claim 4 wherein the metal powder is tungsten (W) or molybdenum (Mo).

6. A method of manufacturing an impregnated cathode, including the steps of:

separately fabricating a first conductive porous element and a second conductive porous element whose porosity is lower than that of the first porous element, the second porous element having a concave capable of accommodating the first porous element;

grinding a surface of the second porous element to form a nonporous surface; and fixing the first porous element into the concave of the second porous element and having the first and second porous elements each impregnated with an electron emitting substance.

7. A method of manufacturing an impregnated cathode with an electron emitting region and a peripheral region other than the electron emitting region in a surface thereof, including the steps of:

molding a plurality of conductive substances and fabricating a plurality of porous elements;

provisionally sintering each of the porous elements so that the shrinkage factors thereof are different from one another;

sintering the porous elements combined with one another and fixing the porous elements to one another; and having the porous elements each impregnated with an electron emitting substance.

8. A method according to claim 7 wherein a first porous element corresponds to part corresponding to the electron emitting region and a second porous element corresponds to part corresponding to the peripheral region are at least fabricated as the plurality of porous elements.

9. A method according to claim 8 wherein a shrinkage factor of the first porous element is lower than that of the second porous element.

10. A method according to claim 8 further including the step of grinding a surface of the second porous element to form a nonporous surface.

11. A method according to claim 7 wherein the shrinkage factors of the porous elements are controlled by adjusting a pressure applied thereto for molding.

12. A method according to claim 7 wherein the shrinkage factors of the porous elements are controlled by adjusting a heating temperature or a heating duration for the provisional sintering.

* * * * *

UNITED STATES PATENT AND TRADEMARK OFFICE

CERTIFICATE OF CORRECTION

PATENT NO. : 6,425,793 B1
DATED : July 30, 2002
INVENTOR(S) : Yoji Hasegawa et al.

It is certified that error appears in the above-identified patent and that said Letters Patent is hereby corrected as shown below:

Column 17,
Line 40, replace “including part” with -- including a part --.
Line 41, replace “and part” with -- and a part --.

Column 18,
Line 36, delete “corresponds to part”
Line 37, delete the words “corresponds to”
Line 38, delete the word “part”

Signed and Sealed this

Fifteenth Day of April, 2003

JAMES E. ROGAN
*Director of the United States Patent and Trademark Office*